United States Patent [19]

Mölzer et al.

[11] Patent Number: 4,512,560

[45] Date of Patent: Apr. 23, 1985

[54] APPARATUS FOR MOUNTING RAILS ON A RIGID RAIL BEAM

[75] Inventors: Peter Mölzer, Ebersberg; Jürgen Pollner; Nicola Topic, both of Munich; Gregor Trummer, Aschering; Rudolf Zurek, Gröbenzell, all of Fed. Rep. of Germany

[73] Assignee: Krauss-Maffei Aktiengesellschaft, Munich, Fed. Rep. of Germany

[21] Appl. No.: 419,425

[22] Filed: Sep. 17, 1982

[30] Foreign Application Priority Data

Oct. 6, 1981 [DE] Fed. Rep. of Germany ..... 3139636

[51] Int. Cl.[3] ..... B25B 11/02

[52] U.S. Cl. ..... 269/20; 269/43; 269/45; 104/2; 29/559

[58] Field of Search ..... 104/2, 7 R, 7 B; 269/37, 43, 44, 45, 20; 29/559

[56] References Cited

U.S. PATENT DOCUMENTS

| | | | |
|---|---|---|---|
| 2,996,016 | 8/1961 | Keller | 104/7 R X |
| 3,318,259 | 5/1967 | Oville | 104/2 |
| 3,821,932 | 7/1974 | Theurer et al. | 104/7 B |

*Primary Examiner*—Frederick R. Schmidt

*Assistant Examiner*—Steven P. Schad

*Attorney, Agent, or Firm*—Karl F. Ross; Herbert Dubno

[57] ABSTRACT

An apparatus for mounting relatively small and deformable elongated rails on a relatively large, generally horizontal, and nondeformable elongated rail beam has a stiff but limitedly elastically deformable elongated jig. A plurality of clamps spaced longitudinally along the jig are engageable with the rail for locking onto the rail at respective longitudinally spaced locations. Respective vertical and horizontal jacks transversely engage between the clamps and the jig for elastically deforming the jig into a desired shape relative to the rail beam. Holders and the like are provided on the jig for securing the deformable rails to the rail beam in predetermined positions relative to the deformed jig. If the rail section is to be curved in any direction the jig is appropriately deformed relative to the rail beam so its various holders and mounting fixtures lie on the appropriate curve. Such elastic deformation of the jig therefore perfectly positions these rail holders. The clamps include respective horizontal and transverse clamp beams at the locations, respective jaws on the beams, and respective hydraulic actuators for locking the jaws on the rail beam at the respective locations and thereby solidly arresting the transverse beams on the rail beam at the respective locations.

14 Claims, 4 Drawing Figures

APPARATUS FOR MOUNTING RAILS ON A RIGID RAIL BEAM

FIELD OF THE INVENTION

The present invention relates to apparatus for mounting rails on a rigid rail beam. More particularly this invention concerns the building of a rail for a linear-motor type of electromagnetic train.

BACKGROUND OF THE INVENTION

The rail of a linear-motor electromagnetic train has a massive reinforced-concrete rail beam that is cast normally in situ. On it are a pair of horizontally spaced, parallel, and horizontally oriented support rails and a pair of horizontally spaced, parallel, and vertically oriented guide rails. In operation the train floats, that is suspends itself magnetically, with respect to these rails, and the linear motor of the train pulls the thus suspended train along.

Even with the most careful construction techniques, it is normally impossible to cast the concrete rail beam, which is a massive T-section construction, within tolerances of more than +/−20 mm. For high-speed travel the electromagnetic train needs to have guide and support rails positioned within +/−3 mm of an ideal orientation. This tight tolerance is essential for high-speed travel of a train supported on a magnetic field.

Thus it is standard practice to painstakingly mount the guide and support rails on the reinforced-concrete rail beam by appropriate fasteners and spacers, normally providing a layer of special-mix concrete underneath the rails. Various gauges and alignment devices, basically of the type used on standard wheel-type tracks, are employed for accurately positioning these rails. The job is complicated further because the guide and support rails are very close to each other. Obviously such mounting of the rails is an extremely onerous procedure that adds greatly to the first costs of such a transit system.

OBJECTS OF THE INVENTION

It is therefore an object of the present invention to provide an improved apparatus for mounting rails on a rail beam.

Another object is the provision of such an apparatus for mounting rails on a rail beam which overcomes the above-given disadvantages.

In general it is an object of this invention to make it easy to mount the rails in place so that the operation can be done rapidly and inexpensively.

SUMMARY OF THE INVENTION

These objects are attained according to the instant invention in an apparatus for mounting relatively small and deformable elongated rails on a relatively large, generally horizontal, and nondeformable elongated rail beam. The apparatus has a stiff but limitedly elastically deformable elongated jig, means including a plurality of clamps spaced longitudinally along the jig and engageable with the rail beam for locking onto the rail beam at respective longitudinally spaced locations, means including respective vertical and horizontal jacks transversely engaged between the clamps and the jig for elastically deforming the jig into a desired shape relative to the rail beam, and mounting means on the jig for securing the deformable rails to the rail beam in predetermined positions relative to the deformed jig.

The mounting means according to the invention includes holding means for positioning the rails in a predetermined position relative to the deformed jig and adjacent respective surfaces of the rail beam. Thus with the system of this invention the jig normally is perfectly straight so that guide and support rails secured to its various holders are perfectly aligned for straight rail sections. If the rail section is to be curved in any direction the jig is appropriately deformed relative to the rail beam so its various holders and mounting fixtures lie on the appropriate curve. Such elastic deformation of the jig therefore perfectly positions these rail holders. No individual measurements and positionings need be done one by one. Instead the rails for a substantial section can be perfectly positioned, normally by bolting, shimming, and underfilling with special concrete in one simple operation.

According to another feature of this invention the jig includes horizontal, generally parallel, and transversely spaced longitudinal frame members and horizontal and longitudinally spaced transverse frame members transversely bridging the longitudinal frame members. The clamp means includes respective horizontal and transverse clamp beams at the locations, respective jaws on the beams, and respective hydraulic actuators for locking the jaws on the rail beam at the respective locations and thereby solidly arresting the transverse beams on the rail beam at the respective locations. These clamp beams are therefore locked on the rail to provide a firm base for the cylinders which deform the jig. Such a jig frame can be twisted and distorted with its longitudinal members remaining substantially perfectly parallel, unless of course the entire frame is somewhat twisted as is necessary at the end of a banked curve or the like.

The vertical and horizontal jacks of this invention each have a lower end pivoted on a respective one of the clamp beams about a respective longitudinal axis and an upper end pivoted on the jig about a respective longitudinal axis. These jacks are stiff but extensible between their ends.

The jig of this invention has a transverse member lying above and generally parallel to each clamp beam. The vertical jacks are provided in pairs, transversely spaced and extending between each clamp beam and the respective transverse member and the horizontal jacks extend diagonally, that is at an angle to the horizontal, between each clamp beam and the respective transverse member. Such a combination of jacks allows the jig to be deformed into any shape needed for this particular application.

In accordance with the invention the jig has four such transverse members each associated with a respective clamp beam each in turn having respective jaws and a respective hydraulic actuator. Such a structure can be deformed into an S-shape, such as needed where a curve to one side becomes an opposite curve.

It is also possible according to this invention to provide special means for twisting the jig about a transverse axis. In one arrangement this twisting means includes respective pairs of longitudinally oppositely projecting arms on the transverse members and thereunder on the clamp beams. Each arm of each clamp beam is spaced horizontally and perpendicularly to the longitudinal members from the respective arm of the respective transverse member. Respective oppositely diagonally extending jacks have lower ends pivoted on the respective arms of the respective clamp beams about respective longitudinal axes and upper ends pivoted on the respective arms of the respective transverse members about respective longitudinal axes. Such an arrangement can exert a twisting action at one point in the jig about a vertical axis perpendicular to the jig.

The twisting means of this invention also may be constituted as described above but with vertical twisting jacks pivotal on the arms about horizontally transverse axes. This arrangement exerts a twisting action at one point in the jib about a horizontal axis perpendicular to the jig.

In accordance with another feature of this invention the device has sensor means for measuring the deviation of the actual position of the jig from a predetermined standard position and control means connected between the sensor means and the jacks for actuating same and distorting the jig into a desired position in accordance with the sensed actual position. This sensor means functions optically and has a laser-beam emitter directed longitudinally along the jig, means for supporting the emitter at one longitudinal end of the jig with the beam directed longitudinally along the jig, a mirror fixed on the jig offset from the one end thereof and positioned to intercept and at least partially laterally deflect the beam, and a laser target fixed on the jig laterally in line with the deflected laser beam. The mirror can be semireflecting so the beam is first sighted through the mirror on a target at the opposite end of the jig, then the deflection is read off the target. Such deflection will be exactly proportional to the deformation of the jig, allowing even relatively unsophisticated machine operators to set up the device for the desired deformation. It is also possible for the sensor means to employ piezoelectric strain gauges appropriately positioned on the frame members of the jig to detect the deformation of the longitudinal members.

To allow the apparatus of this invention to operate efficiently, it has a platform extending horizontally and longitudinally above the jig and means including a plurality of trucks for supporting the platform on the rail beam for longitudinal rolling travel thereon. A plurality of vertically extensible jacks engaged between the clamps and the platform are extensible for supporting the platform on the clamps with the trucks clear of the rail beam and contractile for hanging the jig from the platform supported by the trucks on the rail beam. The platform is sufficiently large and the trucks are sufficiently robust that the platform can support a plurality of workers as well as a supply of the rails. Thus this platform can serve the function of supporting the operators and their supplies, and of transporting the jig along the rail beam. The machine can work itself along the rail beam, normally pushed by a simple donkey engine or the like as it mounts guide rails on one track section after another.

The apparatus according to this invention can be bent into several different shapes relatively easily. Expanding the horizontal jacks of the end transverse members while oppositely contracting the horizontal jack of the middle transverse member horizontally and laterally bows, that is decreases the radius of curvature of, the jig. Expanding the vertical jacks of the end transverse members while oppositely contracting the vertical jack of the middle transverse member upwardly bows the jig. Contracting the vertical jacks of the end transverse members while oppositely expanding the vertical jack of the middle transverse member downwardly bows the jig. Expanding some of the vertical jacks closer to one longitudinal member and oppositely contracting the other jacks of the same pairs twists the jig relative to the rail beam about a longitudinal axis. Expanding all of the verticl jacks closer to one longitudinal member and oppositely contracting the other vertical jacks tips the jig relative to the rail beam.

DESCRIPTION OF THE DRAWING

The above and other features and advantages will become more readily apparent from the following, reference being made to the accompanying drawing in which.

SPECIFIC DESCRIPTION

Figure 1:
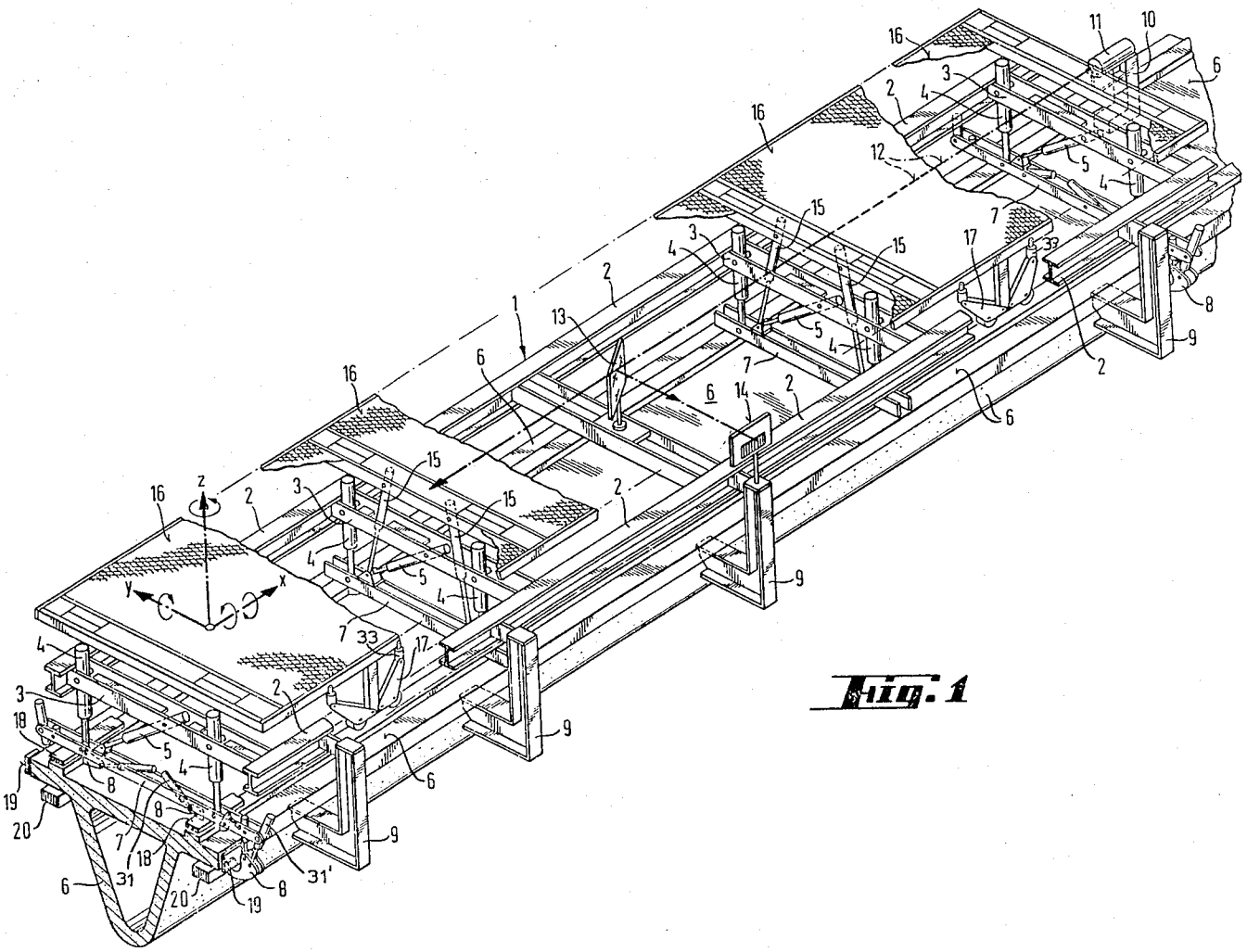
FIG. 1 is a generally perspective view of the apparatus of this invention.
Figure 2:
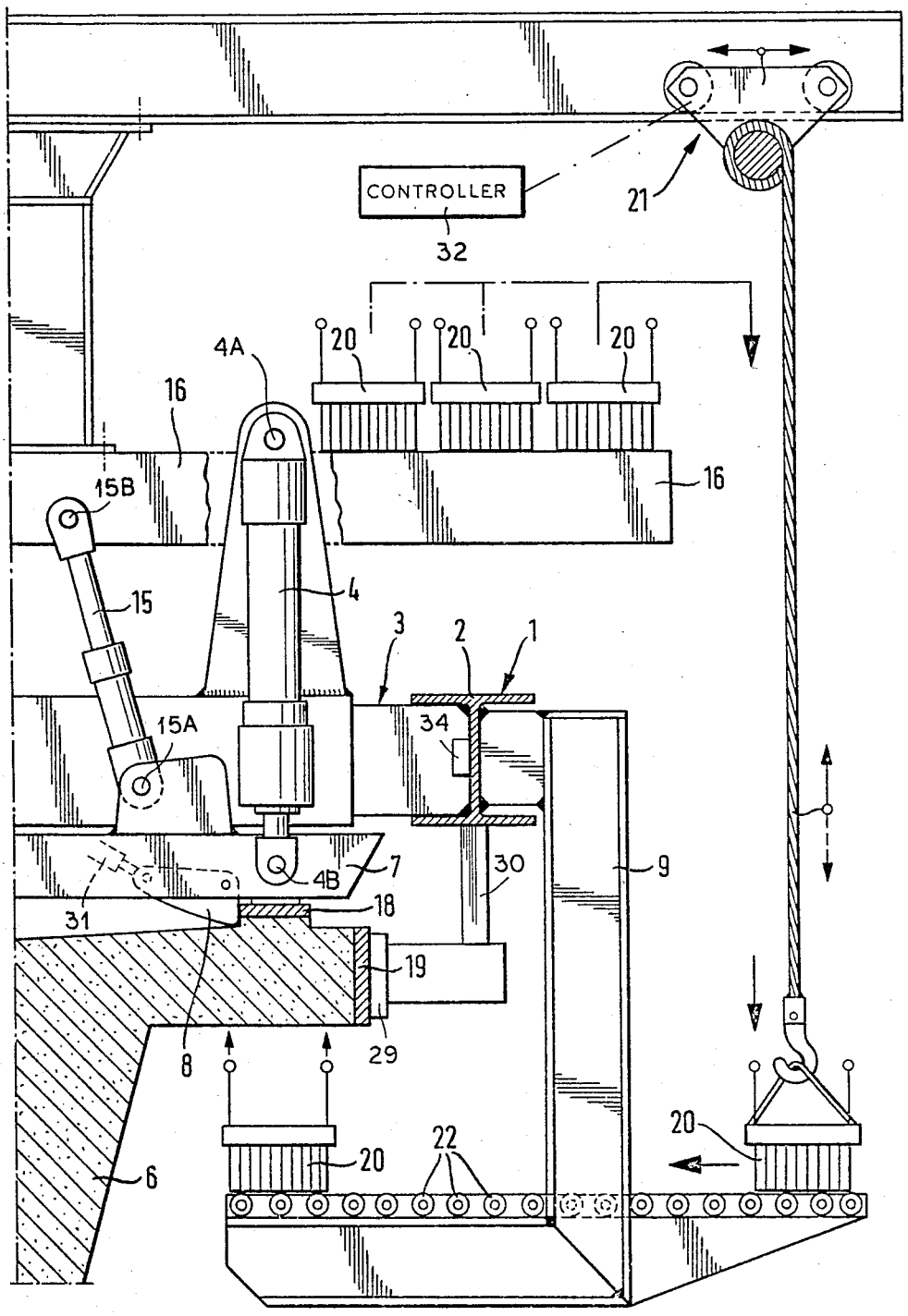
FIG. 2 is a vertical section through the apparatus.

As seen in FIG. 1, the apparatus according to this invention basically comprises a frame or jig 1 made of steel I-beam longitudinal members 2 and a plurality of similar transverse members 3 bridging these longitudinal members 2. Under and parallel to each transverse member 3 is a clamp beam 7 that is provided with movable clamp jaws 8 and 8' that can be locked on a standard T-section reinforced-concrete rail beam 6 by means of respective hydraulic cylinders 31 and 31'. Post-like vertical hydraulic cylinders or jacks 4 extend from the outer ends of each clamp beam 7 to the corresponding outer end of the overlying transverse member 3, each such jack 4 being pivoted on the respective transverse member 3 about a longitudinal axis 4A (FIG. 2) and on the respective beam 7 about a parallel axis 4B. In addition a diagonal hydraulic cylinder 5 which is controlled by an electronic controller 32 like the cylinders 4, extends at an angle to the horizontal between each transverse member 3 and the respective clamp beam 7. The ends of the cylinders 5 are pivoted about longitudinal axes on the respective transverse members 3 and clamp beams 7.

The jig 1 has a plurality of downwardly extending arms or supports 9 and 30. The arms 9 support a conveyor 22 for stator packs 20 and the support 30 carries a holder 29 for mounting a lateral guide rail 19 to a vertical face of a respective arm of the rail beam 6.

At one longitudinal end of the jig 1 is a support 10 carrying a standard laser emitter 11 whose beam 12 is projected perfectly longitudinally of the jig 1, that is horizontally and parallel to the longitudinal beams 2, to the opposite end. In the middle of the jig 1 a mirror 13 mounted on a transverse member reflects the beam 12 partially to the side to a target 14 carried on one of the arms 9 and provided with photocells connected to the controller 32 by means not shown for clarity of view. In addition strain gauges 34 (one seen in FIG. 2) are secured to the longitudinal and transverse members 2 and 3 to sense any deformation of them and feed appropriate outputs to the controller 32.

Generally vertical pairs of jacks 15 are pivoted at their lower ends at longitudinal axes 15A on the clamp beams 7 and at their upper ends at axes 15B on a longitudinally extending platform 16 extending the full length and width of the jig 1. This platform 16 is normally supported by trucks 17 on the support rails 18. Cylinders 33 can vertically displace the trucks 17 to seat it firmly even on a nonlevel beam 6.

This platform 16 serves two main functions, for both of which it is supported on the rail beam 6 by the trucks 17. It holds supplies of rails 18 and 19 as well as of stator packs 20 and a winch or crane 21 for moving these supplies into position on the rail beam 6. In addition the cylinders 15 can be retracted when the clamp elements 8 have been released from the beam 6 to raise the jig 1 and allow it to be transported along the beam 6, hanging under the platform 16 that can roll on its trucks 17. Thus the cylinders or jacks 15, which are tipped inwardly to center the jig 1 and platform 16, serve only to lift up and suspend the jig 1 during such transport and can in fact be single-acting, contraction-only cylinders.

With the above-decribed system it is therefore possible to lock the beams 7 tightly on the rail beam 6. After this is done the transverse cylinder 5 and jacks 4 are pressurized to center the trailing end of the jig 1 on the downstream ends of the rails 18 and 19 just installed and this setting is left in these cylinders 5 and 4. Then the other cylinders 4 and 5 can be appropriately pressurized by the controller 32 in accordance with the desired curvature as determined by feedback from the laser arrangement 10–14 and the strain gauges 34 to appropriately deform the jig 1. More particularly:

1. To laterally bow the jig 1 the two end cylinders 5 are expanded or contracted and the two center cylinders 5 are oppositely contracted or expanded. This is deformation about the axis z.

2. To upwardly or downwardly bow the jig 1 the end cylinders 4 are expanded or contracted and the center cylinders 4 are oppositely contracted or expanded. This is deformation about the axis y.

3. To twist the jig 1 the two cylinders 4 at one end are expanded on one side and contracted on the other and the cylinders 4 of the opposite end are oppositely contracted and expanded. This is deformation about the axis x. In addition it is possible to combine most of these styles of deformation with each other to achieve any compound curving desired. Similarly since there are four diagonal cylinders 5 and pairs of vertical cylinders 4 it is possible to alternately oppositely pressurize them to achieve an S-shape.

Typically the apparatus of this invention works its way along the track it is making. It is aligned with the already mounted rails 18 and 19 at its trailing end, then is bent into the desired shape and more rails 18 and 19, as well as stator packs 20 if necessary are mounted on the rail beam 6. The rails 18 and 19 are normally mounted in place by means of bolts and shims so they are perfectly positioned, then a special concrete mixture is injected under them to stabilize them permanently.

Figure 3:
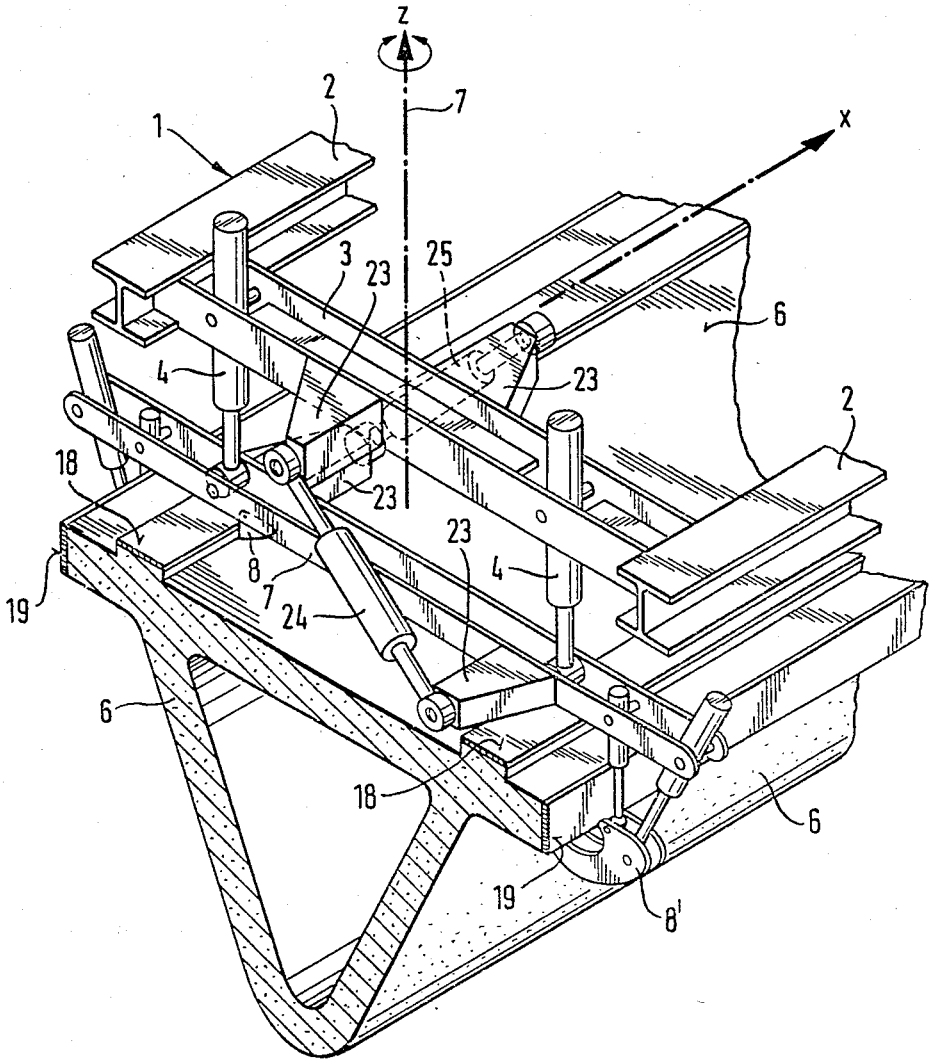
FIGS. 3 and 4 are large-scale partly sectional views of variants on the apparatus of the invention.

FIG. 3 shows another arrangement for deformation about the z axis at one particular member 3. To this end the member 3 and the underlying beam 7 each have a pair of vertically and horizontally spaced longitudinally projecting arms 23 interconnected by diagonal cylinders 24 and 25 that for z-deformation are usually oppositely pressurized.

Figure 4:
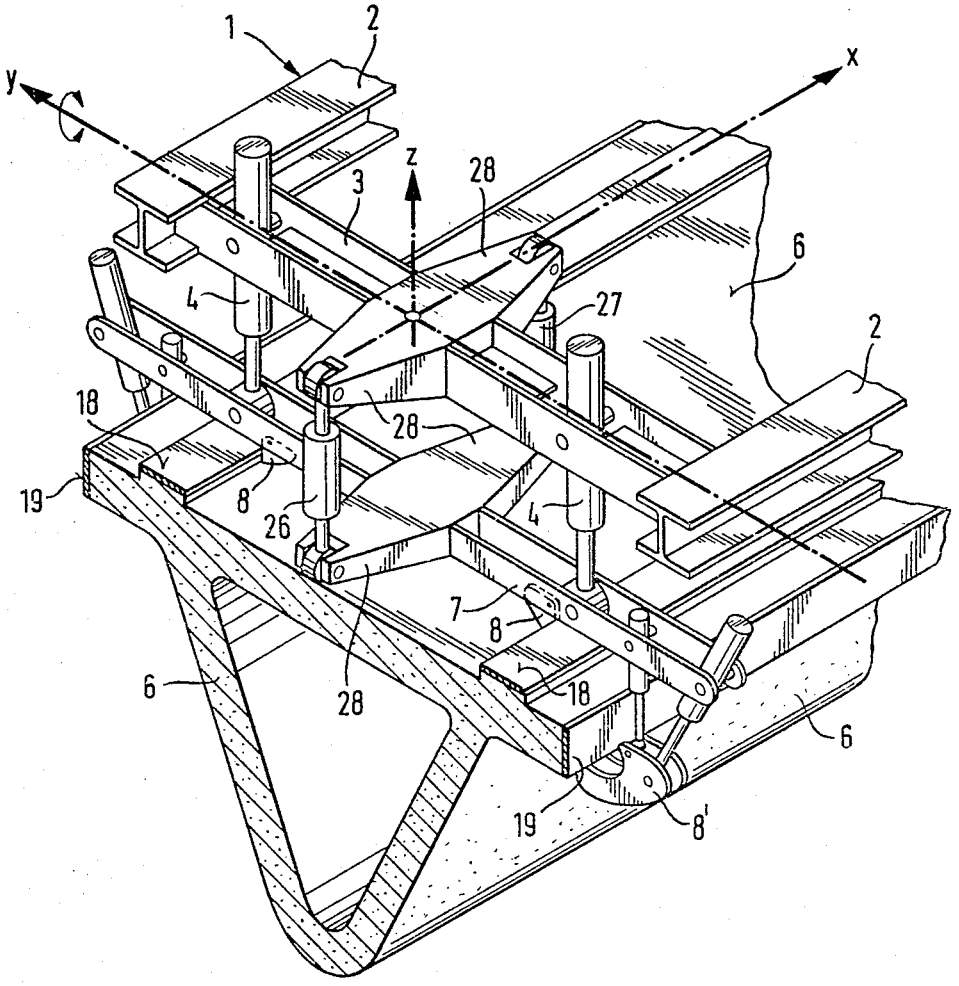

Similarly FIG. 4 shows an arrangement for deformation about the y axis at one particular member 3. To this end the member 3 and the underlying beam 7 each have a pair of vertically spaced and aligned longitudinally projecting arms 28 interconnected by vertical cylinders 26 and 27 that for y-deformation are usually oppositely pressurized.

These arrangements are emloyed when the jig 1 must be made to conform to some particularly troublesome shape. They allow it to be shaped exactly to the particular curve or grade. Although not shown to avoid confusing the view, one such arrangement can be provided on each transverse member 3.

We claim:

1. An apparatus for mounting relatively small and deformable elongated rails on a relatively large, generally horizontal, and nondeformable elongated rail beam, the apparatus comprising:

a stiff but limitedly elastically deformable elongated jig;

means including a plurality of clamps spaced longitudinally along the jig and engageable with the beam for locking onto the beam at respective longitudinally spaced locations;

means including respective vertical jacks and nonvertical jacks transversely engaged between the clamps and the jig for elastically deforming the jig into a desired shape relative to the rail beam; and mounting means on the jig for securing the deformable rails to the jig in predetermined positions relative to the rail beam, said jig including horizontal, generally parallel, and transversely spaced longitudinal frame members and horizontal and longitudinally spaced transverse frame members transversely bridging the longitudinal frame members, said clamp means including:

respective horizontal and transverse clamp beams at the locations, respective jaws on the beams, and respective hydraulic actuators for locking the jaws on the rail beam at the respective locations and thereby solidly arresting the transverse beams on the rail beam at the respective locations.

2. The rail-mounting apparatus defined in claim 1 wherein the mounting means includes holding means for positioning the rails in a predetermined position relative to the deformed jig and adjacent respective surfaces of the rail beam.

3. The rail-mounting apparatus defined in claim 1 wherein the vertical and nonvertical jacks each have a lower end pivoted on a respective one of the clamp beams about a respective longitudinal axis and an upper end pivoted on the jig about a respective longitudinal axis, the jacks being stiff but extensible between their ends.

4. The rail-mounting apparatus defined in claim 3 wherein the jig has a transverse member lying above and generally parallel to each clamp beam, the vertical jacks being provided in transversely spaced pairs between each clamp beam and the respective transverse member, the horizontal jacks extending diagonally between each clamp beam and the respective transverse member.

5. The rail-mounting apparatus defined in claim 4 wherein the jig has four such transverse members each associated with a respective clamp beam each in turn having respective jaws and a respective hydraulic actuator.

6. The rail-mounting apparatus defined in claim 4, further comprising means for twisting the jig about a transverse axis.

7. The rail-mounting apparatus defined in claim 6 wherein the means for twisting include:

respective pairs of longitudinally oppositely projecting arms on the transverse members and thereunder on the clamp beams, each arm of each clamp beam being spaced horizontally and perpendicularly to the longitudinal members from the respective arm of the respective transverse member; and respective oppositely diagonally extending jacks having lower ends pivoted on the respective arms of the respective clamp beams about respective longitudinal axes and upper ends pivoted on the respective arms of the respective transverse members about respective longitudinal axes.

8. The rail-mounting apparatus defined in claim 1, further comprising sensor means for measuring the deviation of the actual position of the jig from a predetermined standard position; and control means connected between the sensor means and the jacks for actuating same and distorting the jig into a desired position in accordance with the sensed actual position.

9. The rail-mounting apparatus defined in claim 8 wherein the sensor means includes optical measuring devices.

10. The rail-mounting apparatus defined in claim 9 wherein the sensor means includes a laser-beam emitter directed longitudinally along the jig.

11. The rail-mounting apparatus defined in claim 10 wherein the sensor means further includes means for supporting the emitter at one longitudinal end of the jig with the laser beam directed longitudinally along the jig;

a reflective element fixed on the jig offset from the one end thereof and positioned to intercept and at least partially laterally deflect the laser beam; and a laser target fixed on the jig laterally in line with the deflected laser beam.

12. The rail-mounting apparatus defined in claim 8 wherein the sensor means includes strain gauges.

13. An apparatus for mounting relatively small and deformable elongated rails on a relatively large, generally horizontal, and nondeformable elongated rail beam, the apparatus comprising:

a stiff but limitedly elastically deformable elongated jig;

means including a plurality of clamps spaced longitudinally along the jig and engageable with the beam for locking onto the beam at respective longitudinally spaced locations;

means including respective vertical jacks and nonvertical jacks transversely engaged between the clamps and the jig for elastically deforming the jig into a desired shape relative to the rail beam;

mounting means on the jig for securing the deformable rails to the jig in predetermined positions relative to the rail beam, said jig including horizontal, generally parallel, and transversely spaced longitudinal frame members and horizontal and longitudinally spaced transverse frame members transversely bridging the longitudinal frame members;

a platform extending horizontally and longitudinally above the jig;

means including a plurality of trucks for supporting the platform on the rail beam for longitudinal rolling travel thereon; and means including a plurality of vertically extensible jacks engaged between the clamps and the platform and extensible for supporting the platform on the clamps with the trucks clear of the rail beam and contractile for hanging the jig from the platform supported by the trucks on the rail beam.

14. The rail-mounting apparatus defined in claim 13 wherein the platform is sufficiently large and the trucks are sufficiently robust that the platform can support a plurality of workers as well as a supply of the rails.

* * * * *